US007335831B2

(12) United States Patent
Laukat et al.

(10) Patent No.: US 7,335,831 B2
(45) Date of Patent: Feb. 26, 2008

(54) BRASS INSTRUMENT

(75) Inventors: Sheryl Laukat, Sandy, UT (US); Tevis Laukat, Sandy, UT (US)

(73) Assignee: Cannonball Musical Instruments, Sandy, UT (US)

( * ) Notice: Subject to any disclaimer, the term of this patent is extended or adjusted under 35 U.S.C. 154(b) by 4 days.

(21) Appl. No.: 11/306,145

(22) Filed: Dec. 16, 2005

(65) Prior Publication Data

US 2006/0196342 A1 Sep. 7, 2006

Related U.S. Application Data

(60) Provisional application No. 60/636,571, filed on Dec. 16, 2004.

(51) Int. Cl.
*G10D 9/00* (2006.01)

(52) U.S. Cl. ..... 84/387 R; 84/400

(58) Field of Classification Search ..... 84/330, 84/380 R, 387, 400
See application file for complete search history.

(56) References Cited

U.S. PATENT DOCUMENTS

| | | | | | |
|---|---|---|---|---|---|
| 59,204 | A | * | 10/1866 | Fiske | 84/387 R |
| 1,632,008 | A | | 6/1927 | Lemm | |
| 1,708,259 | A | * | 4/1929 | Charlton | 84/390 |
| 1,716,929 | A | | 6/1929 | Packan | |
| 1,828,389 | A | | 10/1931 | Calvani | |
| 1,873,184 | A | | 8/1932 | Calvani | |
| 2,033,774 | A | | 3/1936 | Loomis | |
| 2,055,382 | A | | 9/1936 | Loomis | |
| 2,151,337 | A | | 3/1939 | Selmer | |
| 2,211,770 | A | * | 8/1940 | Einhorn | 84/390 |
| 2,457,473 | A | * | 12/1948 | Incampo | 84/382 |
| 2,555,980 | A | | 6/1951 | Loney | |
| 2,846,917 | A | | 8/1958 | Lefevre-Selmer | |
| 3,635,117 | A | * | 1/1972 | Nagao | 84/380 R |
| 3,657,464 | A | | 4/1972 | Pascucci | |
| 3,769,871 | A | * | 11/1973 | Cawthorn | 84/291 |
| 3,865,005 | A | | 2/1975 | Carree | |
| 4,250,791 | A | | 2/1981 | Tairadate | |
| 4,453,445 | A | | 6/1984 | Todd | |
| 4,559,859 | A | * | 12/1985 | Pilczuk | 84/394 |
| 4,589,322 | A | * | 5/1986 | Finkenbeiner | 84/402 |
| 5,267,499 | A | * | 12/1993 | Othon | 84/291 |
| 5,539,147 | A | * | 7/1996 | Hoshino | 84/723 |

(Continued)

OTHER PUBLICATIONS

National Music Museum (images), Everist and Beede Galleries, Jeweled Cornet by Conn, NMM 4572 www.usd.edu/smm/everist.html; Pair of Shawms, NMM2584, www.usd.edu/smm/Tibet/w584/Shawms2584.html.*

(Continued)

*Primary Examiner*—Lincoln Donovan
*Assistant Examiner*—Robert W Horn
(74) *Attorney, Agent, or Firm*—Advantia Law Group; Michael W. Starkweather; Jason P. Webb

(57) ABSTRACT

A brass instrument with improved tonal characteristics that includes a tonal material attached to the brass instrument. The instrument may be a trumpet. The tonal material may have a Mohs hardness of greater than about 6, such as a semi-precious stone. Also disclosed is a method of improving tonal characteristics of a brass instrument by attaching a tonal material to the brass instrument.

18 Claims, 11 Drawing Sheets

U.S. PATENT DOCUMENTS

| | | | | | |
|---|---|---|---|---|---|
| 5,569,863 | A | * | 10/1996 | Lem | 84/312 R |
| 5,644,095 | A | * | 7/1997 | Davidson | 84/453 |
| 5,783,762 | A | * | 7/1998 | Lindauer | 84/282 |
| 5,900,562 | A | | 5/1999 | Smeding | |
| 5,965,832 | A | * | 10/1999 | Davidson | 84/387 R |
| 5,969,280 | A | * | 10/1999 | Marcinkiewicz | 84/398 |
| 5,986,190 | A | * | 11/1999 | Wolff et al. | 84/297 R |
| 5,990,398 | A | | 11/1999 | Nonaka | |
| 6,034,312 | A | * | 3/2000 | Lubell et al. | 84/384 |
| 6,060,654 | A | * | 5/2000 | Valtchev et al. | 84/453 |
| 6,265,649 | B1 | | 7/2001 | Smeding | |
| 6,613,969 | B1 | * | 9/2003 | Petillo et al. | 84/314 R |
| 6,664,456 | B2 | * | 12/2003 | Momchilovich | 84/400 |
| 7,049,501 | B2 | * | 5/2006 | Shellhammer et al. | 84/400 |
| 7,071,398 | B2 | * | 7/2006 | Hannes | 84/319 |
| 2002/0139237 | A1 | * | 10/2002 | Momchilovich | 84/400 |
| 2006/0196342 | A1 | * | 9/2006 | Laukat et al. | 84/387 R |

OTHER PUBLICATIONS

C. G. Conn History, copyright 2007, detailing history from 1873, www.cgconn.com/content/history.php; more on C.G. Conn, The Incomparible Colonel, history from 1873, www.xs4all.nl/~cderksen/ConnHistory1.html; Banks, Margaret, A Brief History . . . , c. 1997, keys inlaid, mother of pearl, www.usd.edu/~mbanks/Conn11.html.*

Cannonball Musical Instruments, www.cannonballmusic.com/ , Cannonball Chronology, c. 2006, /chronology.php; Semi-Precious Stones, c. 2006, /saxstones.php; Stone Series Trumpets, c. 2006, /stonetrumpets.php.*

Cannonball Stone Series Pro, Review, Dec. 20, 2005; www.brassreview.com/reviews/showproduct.php/product/1840/cat/325.*

Worischek Brass Instruments, Engraving and Jeweled Inlay, viewed May 15, 2007, instrument maker since 1996, web.mac.com/siegfriedscall/iWeb/SiegfriedsCall/RW%20Workshop.html.*

From the House Worischek, German Magazine Sonic in translation, Oct. 3, 2005, Horn with gem stones, http://translate.google.com/translate?hl=en&sl=de&u=http://www.sonic.de/cms/tests/worischek_2-05.html&sa=X&oi=translate&resnum=9&ct=result&prev=/search%3Fq%3DWorischek,%2BRobert%26hl%3Den%26ris%3DGGLD,GGLD:2004-30,GGLD:en.*

"Selmer Balanced Action Saxophone." Don Mackrills Music Stop. 2004. <http://www.donmack.com/Selmer/SelmerBalancedAction.htm>.

"Welcome to Carl's Professional Band Instrument Repair." Carl's Professional Band Instrument Repair. 2005. <http://www.carlsproband.com/services.index.php>.

"iStockphoto.com: saxophone2." IStock International, Inc. 2005. <http://www.istockphoto.com/file_closeup/objects/musical_instruments/80692_saxophone2.php?id=80692>.

"Tech Topics: Interesting Questions . . . " CyberSax. <http://www.cybersax.com/QA/Q&A_prosthetics.html>, viewed Oct. 2005.

"Selmer MK VI Alto Sax Saxophone." Zachary Music. 2002. <http://www.zacharymusic.com/Zachary_Music/ZAS750Lpics.htm>.

"ZeuS ZAS Alto Saxophone Intermediate." Colorado Brass and Woodwinds. 2004. <http://www.co-bw.com/ZAS%20650%20Alto%20Sax%20CBAW.htm>.

"Alto Saxophone Index." Pro Winds. 2005. <http://www.prowinds.com/prowinds_web_2000/instruments/saxophones/index_alto.htm>.

"Soprano Saxophone Index." Pro Winds. 2005. <http://www.prowinds.com/prowinds_web_2000/Instruments/saxophones/index_soprano.htm>.

"Tenor Saxophone Index." Pro Winds. 2005. <http://www.prowinds.com/prowinds_web_2000/instruments/saxophones/index_tenor.htm>.

"Baritone Saxophone Index." Pro Winds. 2005. <http://www.prowinds.com/prowinds_web_2000/instruments/saxophones/index_baritone.htm>.

"Saxophones—Band and Musical Instruments." Dominic's Music—Band and Musical Instruments. <http://www.dominicsmusic.com/searchResult.php?group_id=4>, viewed Oct. 2005.

"Dave Guardala Saxophones." Sax.Co.UK, 2005. <http://www.saxophones.co.uk/index2.html>.

"Conn." A Brief Outline of the Origins of Orchestral Saxophones in F & C. May 2005. <http://web.onetel.com/-gcwoodward/02conn.htm>.

"Yanagisawa Saxophone Necks (Bocals) from Eltham Woodwind and Brass." Eltham Woodwind and Brass. <http://www.elthamwoodwind.com.au/yanagisawa/bocal.html>, viewed Oct. 2005.

"Saxophone Necks by Peter Ponzol." Peter Ponzol: Handcrafted Saxophone Products. <http://www.peterponzol.com/neck_info/neck_information.html>, viewed Oct. 2005.

"PM Woodwind Repair: Saxophone Repair, Used Saxophones, Selmer, Mark VI, Paul Masti . . . " PM Woodwind. <http://www.pmwoodwind.com/instruments.cfm?categoryid=61>, viewed Oct. 2005.

"Selmer (Paris) Serie III Polished Brass, Matte Iacquered Alto saxophone: Neck from Top." SaxForte. <htto://www.saxforte.com/saxophones/Eb_Alto/Eb_Selmer_Paris_Serie_III_Alto/Serle_III_Clear_Alto/s389.JPG>, viewed Oct. 2005.

"The Gloger Crook," Stephen Howard Woodwind Instrument Repairs & Restoration. <http://www.shwoodwind.co.uk/Buying/Gloger.htm>, viewed Oct. 2005.

"Unison Saxophone Necks." Hollywoodwinds. <http://www.unisonsaxophone.com/necks.html>, viewed Oct. 2005.

"Home / Musikinstrumente / Orchesterinstrumente / Holzblasinstrumente / Saxophone / G1." Yamaha Deutschland. <http://www.yamaha_europe.com/yamaha_europe/germany/10_musical_instruments/20_orchestra/10_woodwind/60_saxophones/50_saxophones._necks/G1/index.html/G>, viewed Oct. 2005.

"The Collection of H.N. White Instruments", H.N. White. <http://www.hnwhite.com/instruments.htm>, viewed Oct. 2005.

"King Liberty Trumpet No. 1050: Picture 3 With Mini", H.N. White. <http://www.hnwhite.com/King/My%20Trumpets/Liberty%Trumpet%20With%20Mini%20Trumpet%20Gold.jpg>.

"Trumpets and Comets from Dave Ballard, Isle of Wight." David Ballard. <http://www.daveballard.co/uk/trumpets.htm>, viewed Oct. 2005.

"Trumpet." Azerimusic. <http://www.azerimusic.net/old/lazim/back/pic/trumpet.jpg>, viewed Oct. 2005.

"trumpet." Music at Virginia Tech. <http://www.music.vt.edu/musicdictionary/text/images/trumpet.jpg>, viewed Oct. 2005.

"Trumpet." CentralSource.com. <http://www.centralsource.com/blender/intheworks/trumpet.jpg>, viewed Oct. 2005.

"Dave's Bach Trumpet Page." Electrotheremin.com. <http://www.electrotheremin.com/DS001.html>, viewed Oct. 2005.

"ZeuS Bb Trumpet, Olympus, C Trumpet, Guarnerius." Colorado Brass and Woodwinds. <http://www.co-bw.com/Trumpet%20Main%20CBAW.htm>, viewed Oct. 2005.

"Trumpet." Resonans Musikk. <http://www..korpinstrumenter.no/Prislister/Trumpet1.jpg>.

"Brass Instruments—J. Mansfield Trumpets—Sheet Music Instruments Accessories." MusicCity.com <http://www.musicity.com/brass-7.html>.

"Ferguson Music at Hornguys.com—Fine Musical Instruments." Hornguys.com. <http://www.hornguys.com/hornsinstock.htm>, viewed Oct. 2005.

"Zephyr and Zephyr Special." Zephyr and Zephyr Special Models. <http://www.saxpics.com/king/zephyr.htm>, viewed Oct. 2005.

* cited by examiner

BRASS INSTRUMENT

This application claims benefit of U.S. Provisional Patent application Ser. No. 60/636,571 filed on 16 Dec. 2004 by Sheryl Laukat and Tevis Laukat entitled Trumpet, which is herein incorporated by reference.

BACKGROUND OF THE INVENTION

1. Field of the Invention

The present invention relates generally to brass instruments and, more particularly, to brass instruments with improved tonal characteristics.

2. Description of the Related Art

Brass instruments (labrosones) are generally musical instruments in which the tone is produced by vibration of the lips as the player blows into a resonator or mouthpiece. Brass instruments differ from woodwinds in that woodwind instruments are generally those in which sound is produced by blowing through a mouthpiece against an edge or a vibrating reed, and which the pitch is varied by opening or closing holes in the body of the instrument. Brass instruments have various general ways of varying the tone. In one class of brass instruments, the tone is varied only by increasing or decreasing the rate of vibrations of the lips. In such instruments, the only available tones are those in the harmonic series of the instrument. On example of such an instrument is the bugle. In a third class of brass instruments, the tone may be varied by changing the length of the tubing using a slide. One example of such an instrument is the trombone. In yet another class of brass instruments, the tone may be varied by covering and/or uncovering holes along the body of the instrument. One example of such an instrument is the cornetto. Brass instrument may also vary tone by using a combination of the above techniques.

In another class, the tone may be varied by changing the length of the tubing of the instrument using valves. One example of such an instrument is the trumpet. The general configuration of the various instruments categorized as trumpets has not changed since the trumpet's inception. The trumpet generally includes a mouthpiece in fluid communication with a plurality of valves through a series of curved pipes with each valve controllable by a finger button. Air blown through the mouthpiece flows through the valves and exits through the bell. Trumpets can have from one to three valves to produce many different pitches.

Producing a correct pitch in a brass instrument may be difficult. Often when a single note is played, the instrument produces not only the note, but a series of overtones as well. If the overtones do not have frequencies at the proper levels, the overtones reduce the sound quality of the note played. Often in brass instruments, the overtones deviate from the desired frequencies. Brass instruments are often designed such that particular positions of valves, slides, and the like produce different notes. For example, a trumpet is designed such that the tones of a trumpet are played by depressing valves to vary the length of the tubing. This technique is generally called "slotting," that is, the technique of depressing certain keys to generate a particular tone. A particular note is slotted by depressing the correct valve, or combination of valves. One difficulty in playing a valved brass instrument is that the overtones may not be slotted correctly. That is, though the instrument may be slotted to play the fundamental note correctly, the player may be required to vary the method of buzzing into the instrument to bring the overtones into a correct range, thereby improving the tonal characteristics of the tone played. Thus it remains difficult to play a valved brass instrument because the player is required to correct the pitch due to the overtones deviating from the desired frequencies.

It has been documented that many people, especially those who have been musically trained, are capable of detecting a difference in frequency between two separate sounds which is as little as 2 Hz. Thus, even a slight improvement in one or more of the overtones of a particular note played can have a significant impact on the tonal characteristics of the overall sound of the brass instrument.

Accordingly, attempts have been made to improve, among other things, the tonal characteristics of brass instruments. Various disclosures include brass instruments. For example, U.S. Pat. No. 6,664,456 to Momchilovich discloses resilient material and/or rubber O-rings that are placed at various predetermined locations to reduce unwanted sympathetic vibrations on musical instruments and firearms. This may improve the performance and sound of musical instruments and make them easier to play. The resilient material disclosed in this patent includes rubber O-rings.

Further, U.S. Pat. Nos. 5,965,832 and 5,644,095 to Davidson disclose an improvement to the tone and responsiveness of brass instruments that is achieved by holding pre-shaped pieces of damping material, preferably a waxy, hot-melt adhesive, pressed against surfaces of the instrument tubing sections such as valve casings and tubing sections at particular locations, to reduce sympathetic vibrations of the instrument structure.

U.S. Pat. No. 59,204 to Fiske discloses the interposing of rubber or another suitable elastic substance between the attachments of the main pipe with the bell of a wind instrument.

U.S. Pat. No. 3,635,117 to Nagao discloses a ring fixing structure for a woodwind musical instrument. Rings are fixed around the elongated hollow bodies of the woodwind musical instrument, such as their joints and bell edge for reinforcing and ornamental purposes, grooves are formed, respectively, in opposite portions of the elongated hollow bodies and rings, and an adhesive of hot-melt-type is inserted and disposed in the grooves.

Thus, there exists a need to improve the response (i.e., ease of slotting for achieving a correct tone) of slotted brass instruments. Further, there exists a need to improve the tonal characteristics of brass instruments. In addition, there exists a need to improve tonal consistency and evenness throughout the range of notes playable on a particular brass instrument.

There is also a need to improve the tone quality, focus, clarity, character, warmth, centering and depth of sound produced by a brass instrument.

What is needed is a brass instrument that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available brass instruments. According to one embodiment, the present invention has been developed to provide a brass instrument with improved tonal characteristics, including a tubular section which defines a tonal length, and/or a tonal material attached to the tubular section.

The tubular section may include a mouthpiece area and a lead-pipe extending from the mouthpiece area, and the tonal material may be attached to the lead pipe.

According to one embodiment, the brass instrument may further include a bell, and wherein the tonal material may be attached to the bell.

According to another embodiment the brass instrument may further include a valve, the lead-pipe may further include a return section extending to the valve, and the tonal material may be attached on the return section proximate to the valve.

According to yet another embodiment, the brass instrument may further include a second tubular section, and a valve for altering the tonal length by directing air through the second tubular section, and the tonal material may be attached to the second tubular section.

According to still another embodiment, the brass instrument may further include a valve casing, wherein the tonal material may be attached to the valve casing.

According to an additional embodiment, the brass instrument may further include a slide for altering the tonal length, and the tonal material may be attached to the slide.

According to still another additional embodiment, the tonal material is not mother-of-pearl. The tonal material may have a Mohs hardness of at least about 6. The tonal material may include one selected from the group consisting of: garnet, jasper, agate, aventurine, carnelian, citrine, fluorite, hematite, malachite, obsidian, onyx, tiger's eye, turquoise, unakite, moonstone, peridot, jade, alexandrite, amethyst, chalcedony, quartz, aquamarine, lolite, rhodolite, opal, topaz, tourmaline, tanzanite, diamond, emerald, sapphire, ceylon sapphire, ruby, pumice, tungsten carbide, steel, silicon carbide, boron carbide, strontium titanate, emery, crystolon, corundum, combinations thereof, and the like. The tonal material may be attached with an adhesive.

The brass instrument may be any known in the art, such as one selected from the group consisting of: trumpet, bass trumpet, flumpet, French horn, tuba, Wagner tuba, trombone, superbone, bugle, sousaphone, mellophone, euphonium, flugelhorn, saxhorn, cornet, serpent, sackbut, bazooka, horn, ophicleide, didgeridoo, shofar, conch, alphorn, cornetto, cimbasso, keyed trumpet, and the like.

According to yet another embodiment, the brass instrument may further include a housing, attached to the tubular section, and contacting the tonal material. The housing may substantially encircle the tonal material.

According to a further embodiment is disclosed a method of improving the tonal characteristics of a brass instrument, including the steps of attaching a tonal material to the brass instrument.

The tonal material may be one of the group consisting of: garnet, jasper, agate, aventurine, carnelian, citrine, fluorite, hematite, malachite, obsidian, onyx, tiger's eye, turquoise, unakite, moonstone, peridot, jade, alexandrite, amethyst, chalcedony, quartz, aquamarine, lolite, rhodolite, opal, topaz, tourmaline, tanzanite, diamond, emerald, sapphire, ceylon sapphire, ruby, combinations thereof, and the like. In one embodiment, the tonal material is not mother-of-pearl.

According to still a further embodiment, the method may further include the step of attaching a housing to the brass instrument. The method may further include a step of inserting the tonal material into the housing. The brass instrument may include one of the group consisting of: trumpet, bass trumpet, flumpet, French horn, tuba, Wagner tuba, trombone, superbone, bugle, sousaphone, mellophone, euphonium, flugelhorn, saxhorn, cornet, serpent, sackbut, bazooka, horn, ophicleide, didgeridoo, shofar, conch, alphorn, cornetto, cimbasso, keyed trumpet, and the like.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
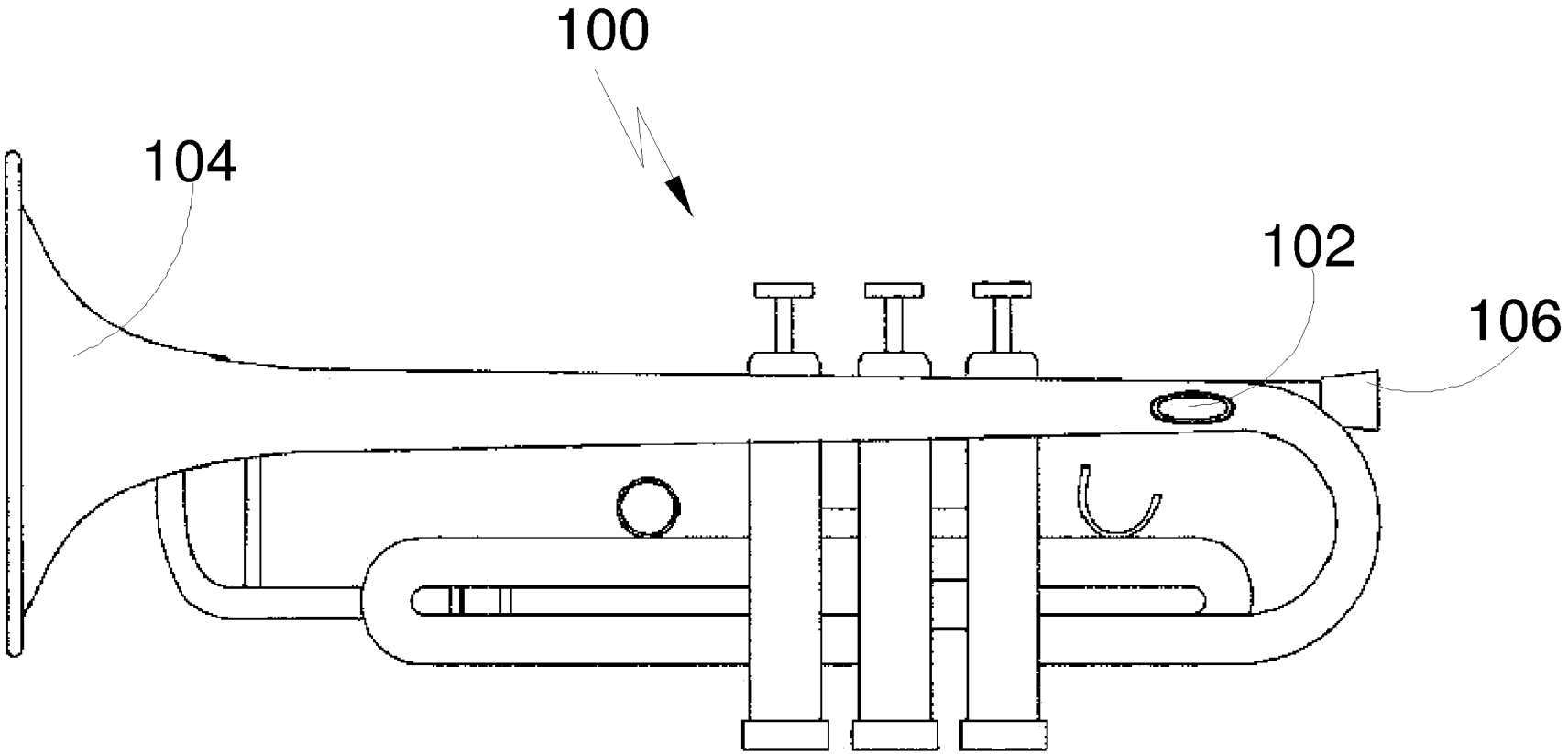
FIG. 1 illustrates a side plan view of a brass instrument according to one embodiment of the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

As used herein, "comprising," "including," "containing," "is," "are," "characterized by," and grammatical equivalents thereof are inclusive or open-ended terms that do not exclude additional, unrecited elements or method steps. "Comprising" is to be interpreted as including the more restrictive terms "consisting of" and "consisting essentially of."

As used herein, "tonal characteristics" includes any of the characteristics such as timbre, pitch, tonal consistency, evenness, tone quality, focus, clarity, character, warmth, centering, and/or depth of sound.

As used herein, "body" includes any part of the body of the woodwind instrument. That is, the body will include the structure through which the forced air and/or sound vibrations flow. The body may include, for example, the mouthpiece, the neck, the body tube, the bell, the bow, and the like.

As used herein, "brass instrument" includes any musical instrument in which the tone is produced by vibration of the lips, also known as labrosones, regardless of the materials of which the instrument may be composed.

As used herein, "tonal length" includes the length traveled by the air and/or sound from the mouthpiece until the air and/or sound exits the brass instrument. This length may be altered, as herein described, using valves, slides, holes, and the like.

FIG. 1 illustrates a perspective view of a brass instrument 100 according to one embodiment of the present invention. Though FIGS. 1-7 illustrate a brass instrument 100 that appears to be in the general form of a trumpet, the present invention may be applied to any brass instrument 100 such as, for example, trumpets, bass trumpets, flumpets, French horns, tubas, Wagner tubas, trombones, superbones, bugles, sousaphones, mellophones, euphoniums, flugelhorns, saxhorns, cornets, cornetto, serpents, sackbuts, bazookas, horns, ophicleides, didgeridoos, shofars, conches, alphorns, cimbassos, keyed trumpets, and the like.

Further, the brass instrument 100 of illustrated in FIG. 1 includes a bell 104 and a mouthpiece area 106. A mouthpiece (not illustrated) may be attached to the mouthpiece area 106. The tonal length extends from the mouthpiece area 106 to the bell 104. Further, a tonal material 102 is placed on the brass instrument 100.

Figure 2:
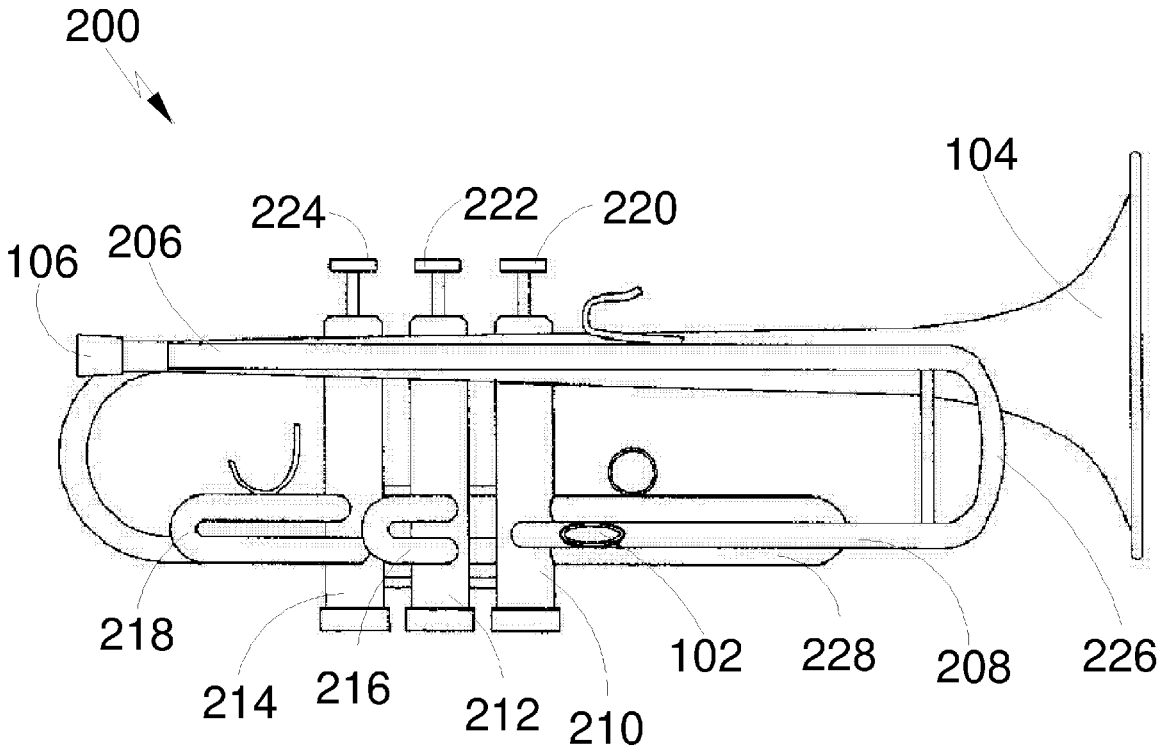
FIG. 2 illustrates a side plan view of a brass instrument according to one embodiment of the present invention.

FIG. 2 illustrates another a perspective view of the brass instrument 100 according to another embodiment of the present invention. FIG. 2 illustrates in more detail some of the various possible parts of the brass instrument 100. The brass instrument 100 illustrated in FIG. 2 is in the general form of a trumpet. The brass instrument 100 may include a bell 104 and a mouthpiece area 106. There may also be a lead pipe 206 extending from the mouthpiece area 106. There may be a return side 208 which extends generally toward the mouthpiece area 106. There may be a connection pipe 226 between the lead pipe 206 and the return side 208. There may be a first, second, and third valves configured to alter the tonal length by directing the sound and/or air through alternative pipes. The valves may be located in a first, second and third valve casing 214, 212, 210, respectively. Further, there may be first, second, and third keys 224, 222, 220, which control the first, second, and third valves, respectfully. Still further, there may be a first, second, and third alternative pipes 218, 216, 228 controlled by the first, second, and third valves, respectfully. Any or all of the alternative pipes 218, 216, 228 may include slides for altering the tonal length through the alternative pipes 218, 216, 228. The return side 208 may lead to the third valve casing 210. There may be a tonal material 102 attached to the return side 108 near the valve casing 210.

Figure 3:
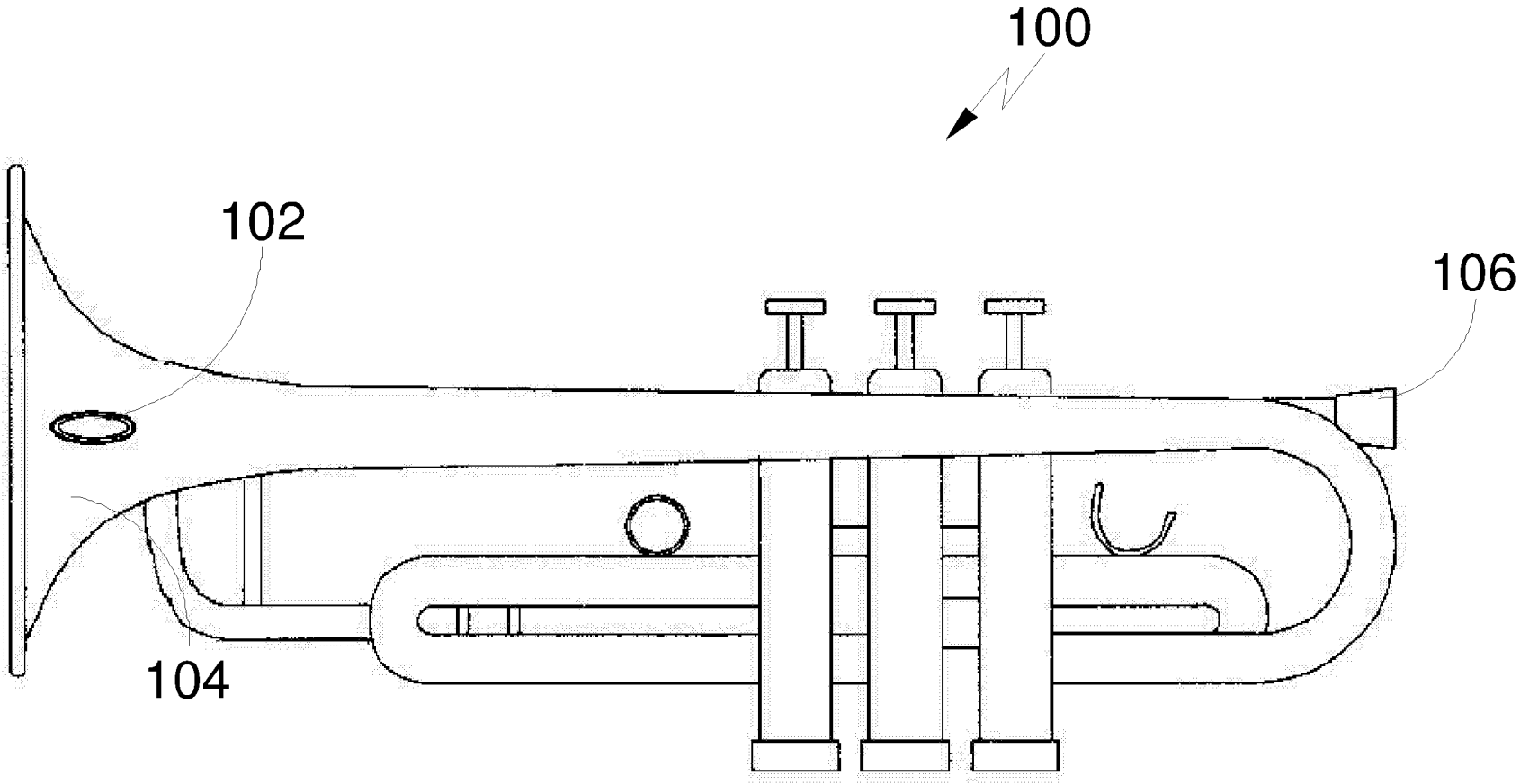
FIG. 3 illustrates a side plan view of a brass instrument according to one embodiment of the present invention.

FIG. 3 illustrates a brass instrument 100 according to one embodiment of the present invention, wherein the brass instrument includes a bell 104 and a mouthpiece area 106. In one embodiment, the tonal material 102 is attached on or near the bell 104.

Figure 4:
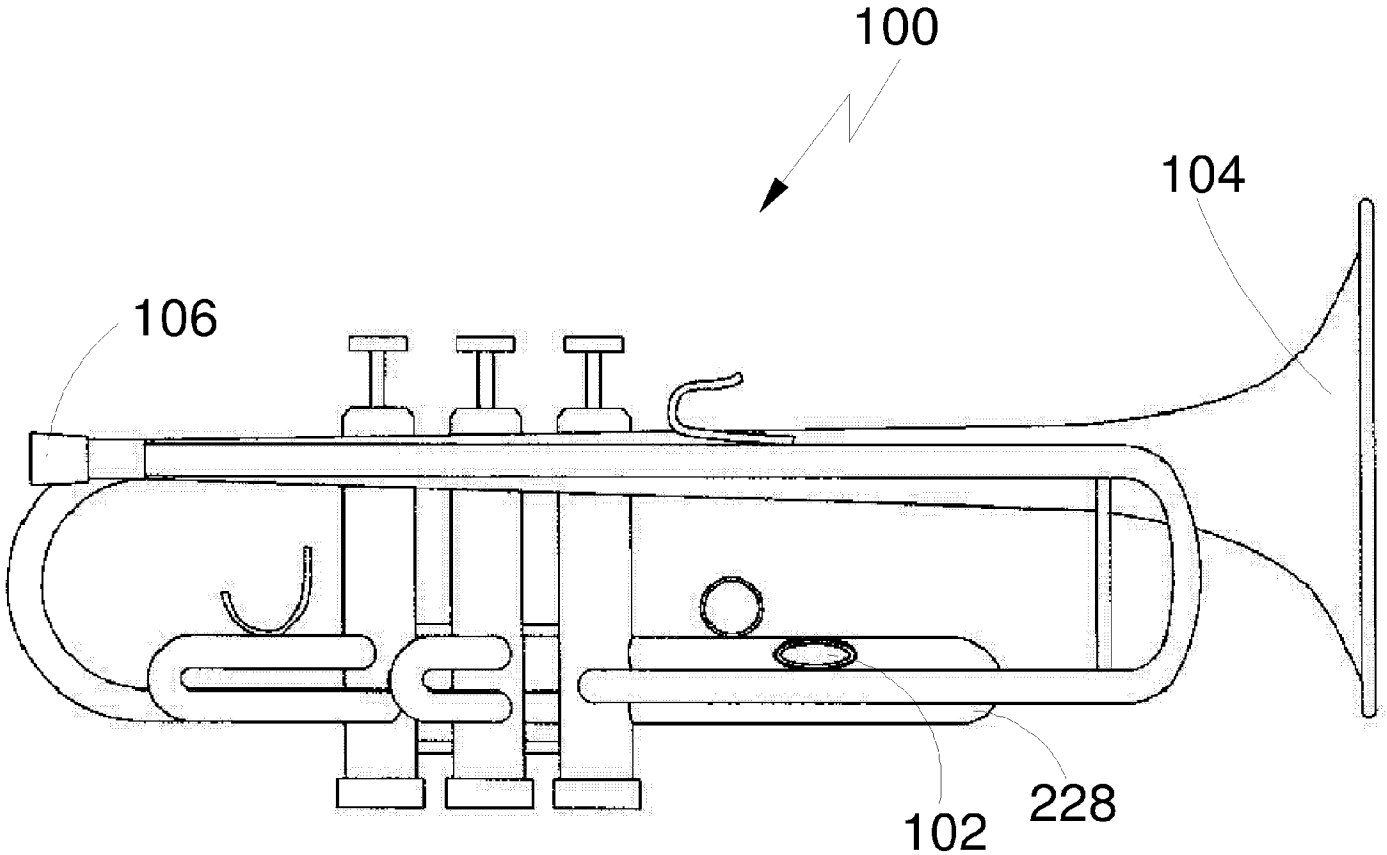
FIG. 4 illustrates a side plan view of a brass instrument according to one embodiment of the present invention.

According to yet another embodiment as illustrated in FIG. 4, the brass instrument 100 may include a third alternative pipe 228, and the tonal material 102 may be attached to the third alternative pipe 228.

Figure 5:
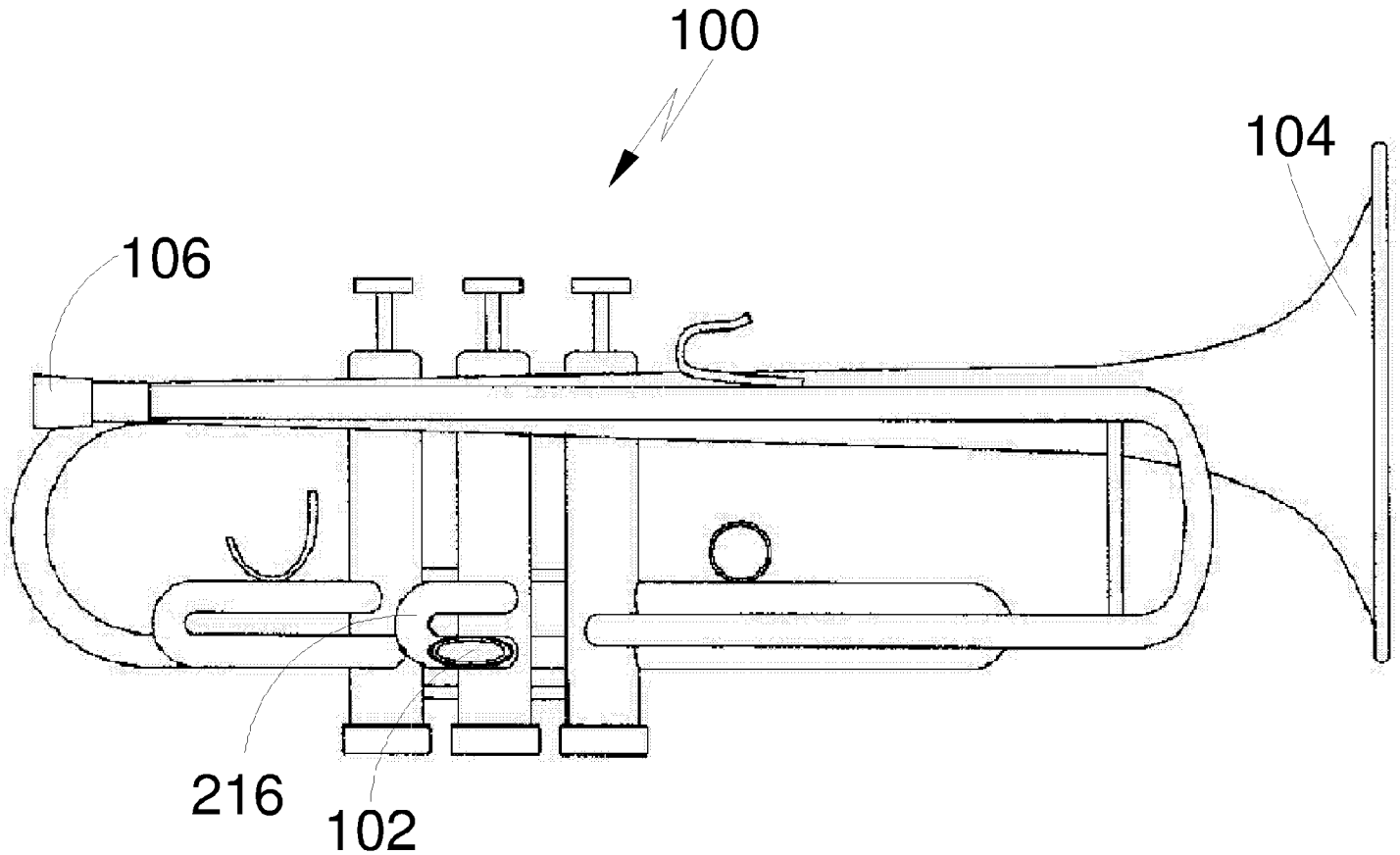
FIG. 5 illustrates a side plan view of a brass instrument according to one embodiment of the present invention.

According to still another embodiment, as illustrated in FIG. 5, the brass instrument 100 may include a second alternative pipe 216, and the tonal material 102 may be attached to the second alternative pipe 216.

Figure 6:
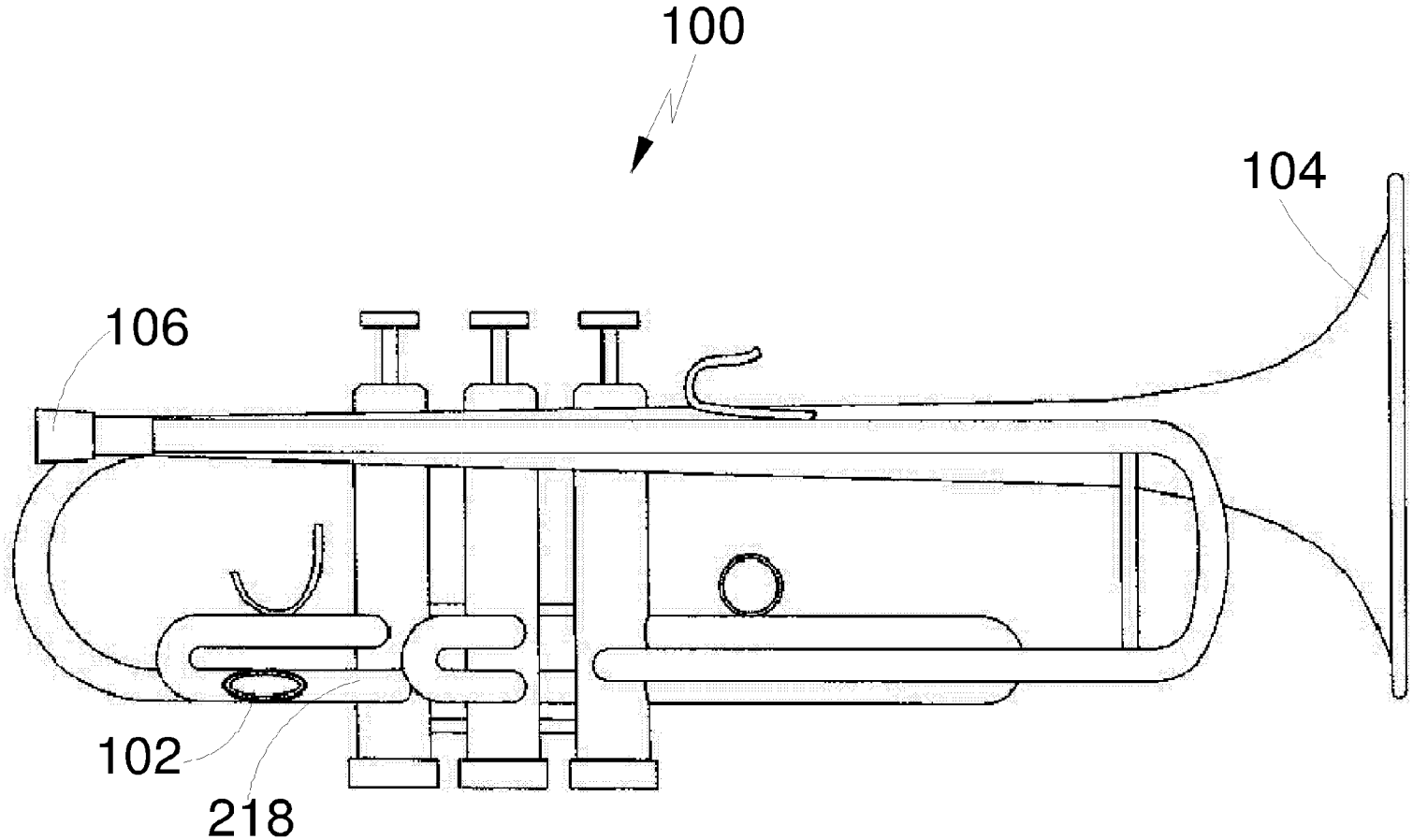
FIG. 6 illustrates a side plan view of a brass instrument according to one embodiment of the present invention.

According to a further embodiment, as illustrated in FIG. 6, the brass instrument 100 may include a first alternative pipe 218, and the tonal material 102 may be attached to the first alternative pipe 218.

Figure 7:
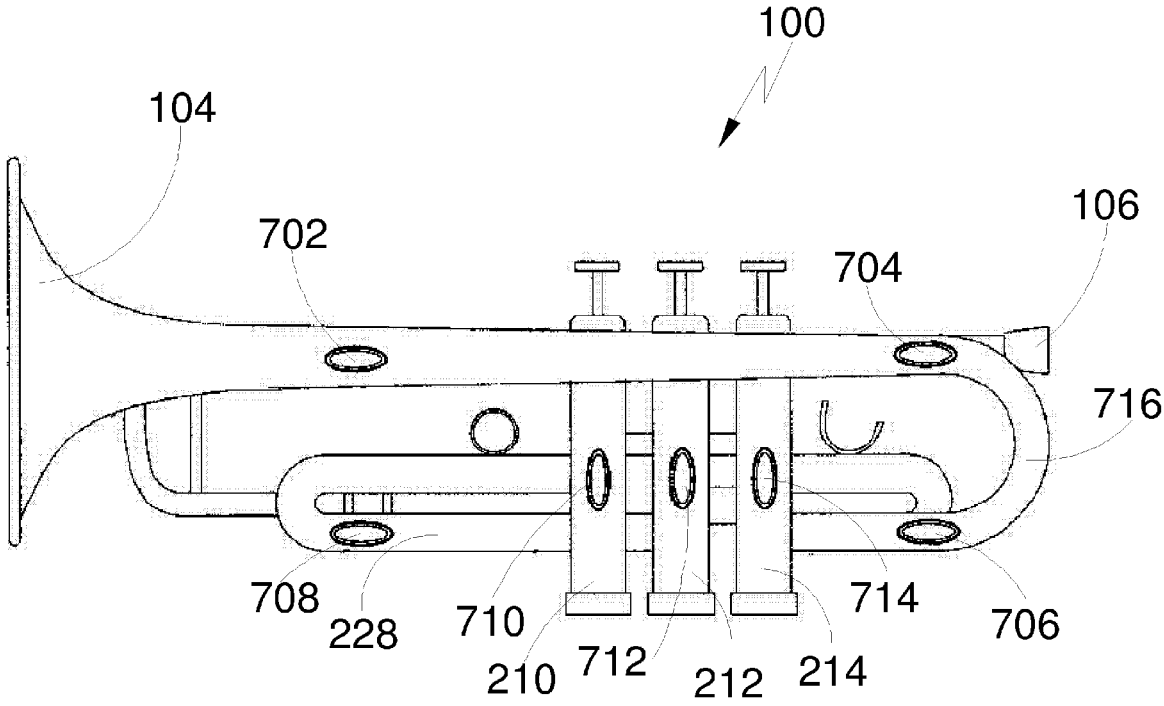
FIG. 7 illustrates a side plan view of a brass instrument according to one embodiment of the present invention.

According to still a further embodiment of the present invention, as illustrated in FIG. 7, the brass instrument 100 may include a first, second, and third valve casings 214, 212, 210, and a first, second, and third tonal material 714, 712, 710, may be attached to the first, second, and third valve casings 214, 212, 210, respectfully. The brass instrument may also include a bell pipe 716 leading from the first valve casing 714 to the bell 104. The bell pipe 716 may include one or more tonal materials 706, 704, 702. The brass instrument may include a third alternative pipe 228 extending from the third valve casing 210, and a tonal material 708 attached to the third alternative pipe 228.

The tonal material of the present invention may be placed anywhere on the tonal length, valve casings, valves, slides, mouthpieces, mouthpiece areas, bells, bows, or hole covers of a brass instrument. Further, there may be multiple places on the brass instrument where the tonal material may be located to affect the tonal characteristics of the brass instrument.

Figure 8:
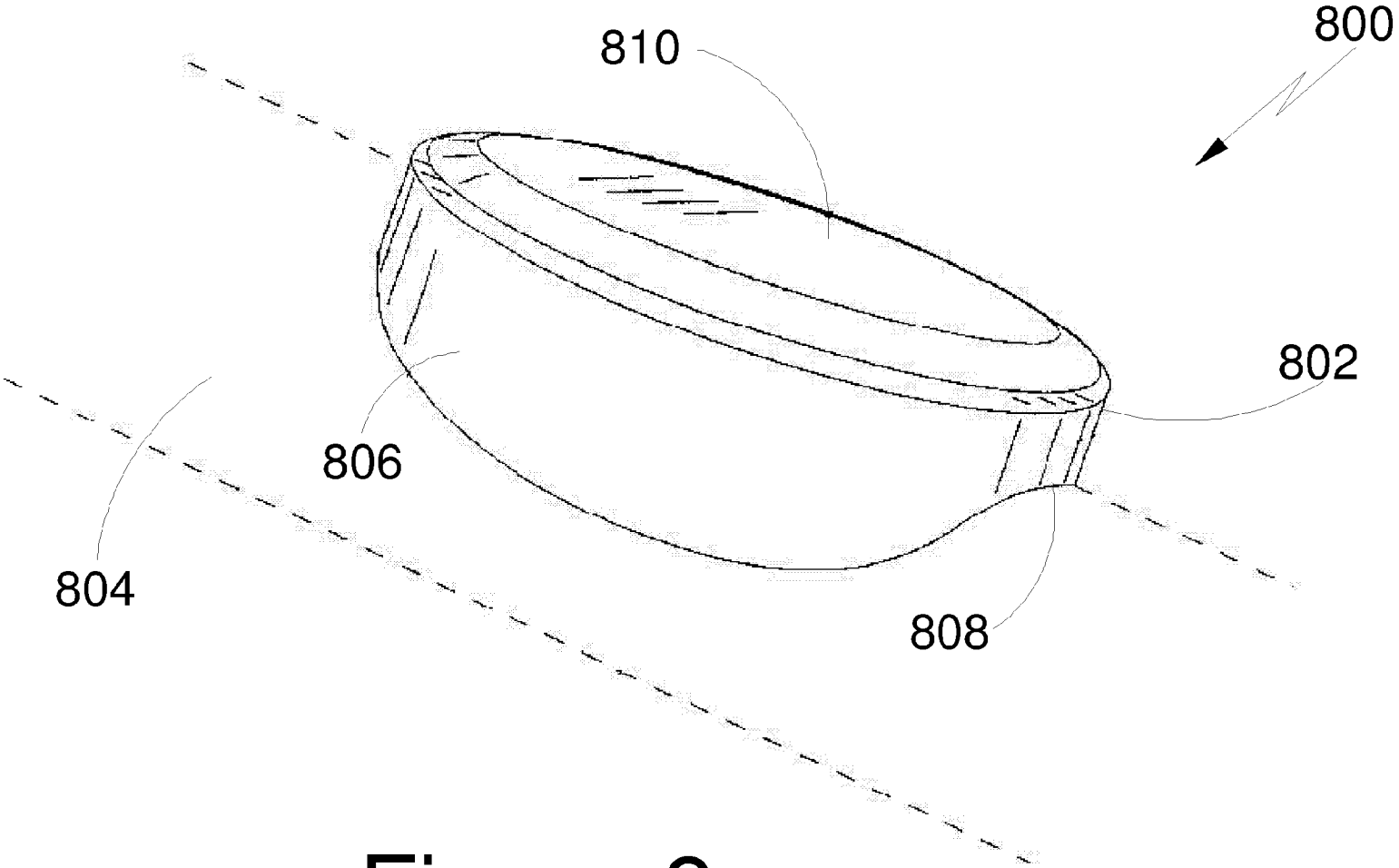
FIG. 8 illustrates a side plan view of a housing and a tonal material according to one embodiment of the present invention.

FIG. 8 illustrates a mount 800 including a housing 802 for attaching the tonal material 810 to the brass instrument according to one embodiment of the present invention. According to this illustration, the tonal material 810 may be attached to a substantially cylindrically-shaped member 804 of the brass instrument such as a tube, pipe, slide, valve casing, or the like. The housing 802 may include a side wall 806 having a contour that generally matches a contour of the tonal material 810 which is inserted therein. The side wall 806 that may include a bottom surface 808 shaped to fit over the contour of the substantially cylindrically-shaped member 804. At least a portion of the bottom surface 808 is attached to the substantially cylindrically-shaped member 804. According to one embodiment, the entire surface 808 is attached to the substantially cylindrically-shaped member 804. The attachment may be by welding, soldering, adhering, or the like. According to one embodiment, the attachment provides a substantially uniform attachment to the substantially cylindrically-shaped member 804 along the entire bottom surface 808. The side wall 806 thereby forms a recess for the tonal material 810 to fit therein. The tonal material 810 may be held within the recess using an adhesive. The adhesive may be applied to the tonal material 810, the substantially cylindrically-shaped member 804, or both. According to another embodiment, the tonal material includes a contour on the side that contacts the substantially cylindrically-shaped member 804 such that matches the substantially cylindrically-shaped member 804.

Figure 9:
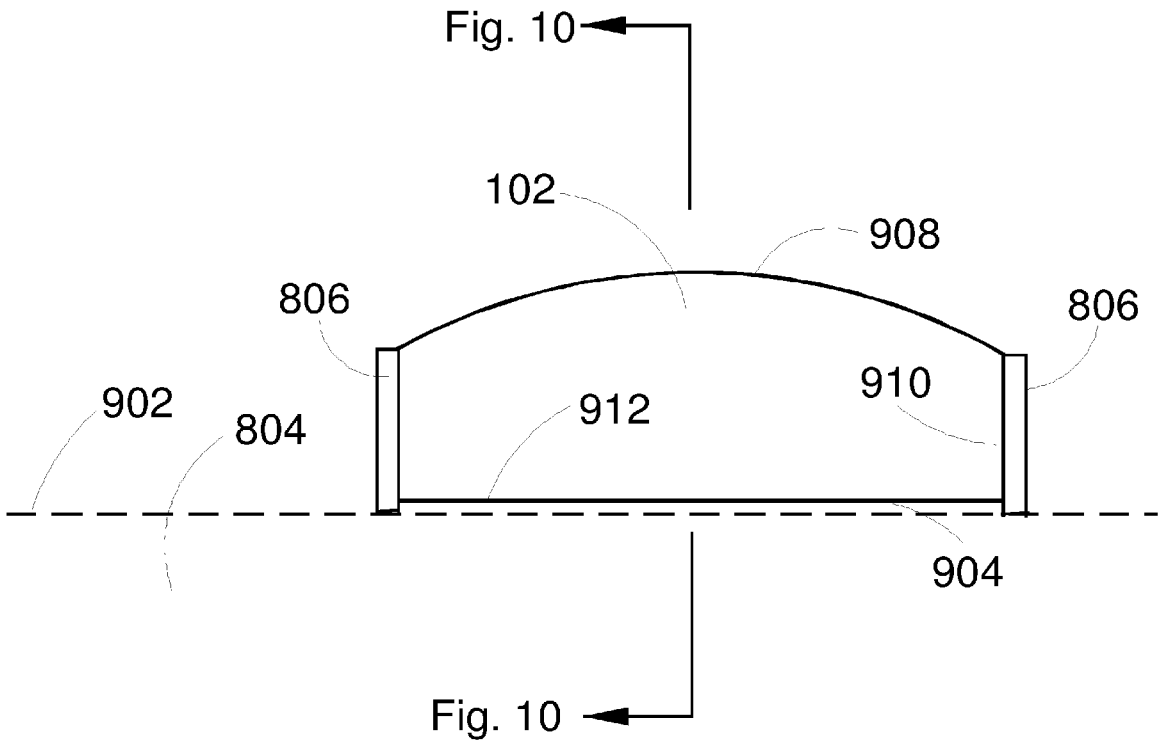
FIG. 9 illustrates a cross sectional view of the tonal material on a brass instrument according to one embodiment of the present invention.

Turning now to FIG. 9, a cross section view of the tonal material 102 placed on a brass instrument is shown. The tonal material 102 may be placed proximate a surface 902 of a substantially cylindrically-shaped member 804. There may be a layer of adhesive 904 between the bottom surface 912 of the tonal material 102 and the surface 902. The side wall 806 is illustrated abutting the surface 902. The side wall 806 is also illustrated as abutting the side of the tonal material 910. In one embodiment, the tonal material 102 contacts the surface 902 directly, having no adhesive therebetween. In another embodiment, the tonal material 102 is held in place by pressure between the tonal material 102 and the side wall 806, or an adhesive between the tonal material 102 and the side wall 806. The outer surface 908 of the tonal material 102 may face away from the bottom surface 912 of the tonal material 102. The outer surface 908 may be curved, beveled, convex, concave, irregularly-shaped, or any suitable shape.

Figure 10:
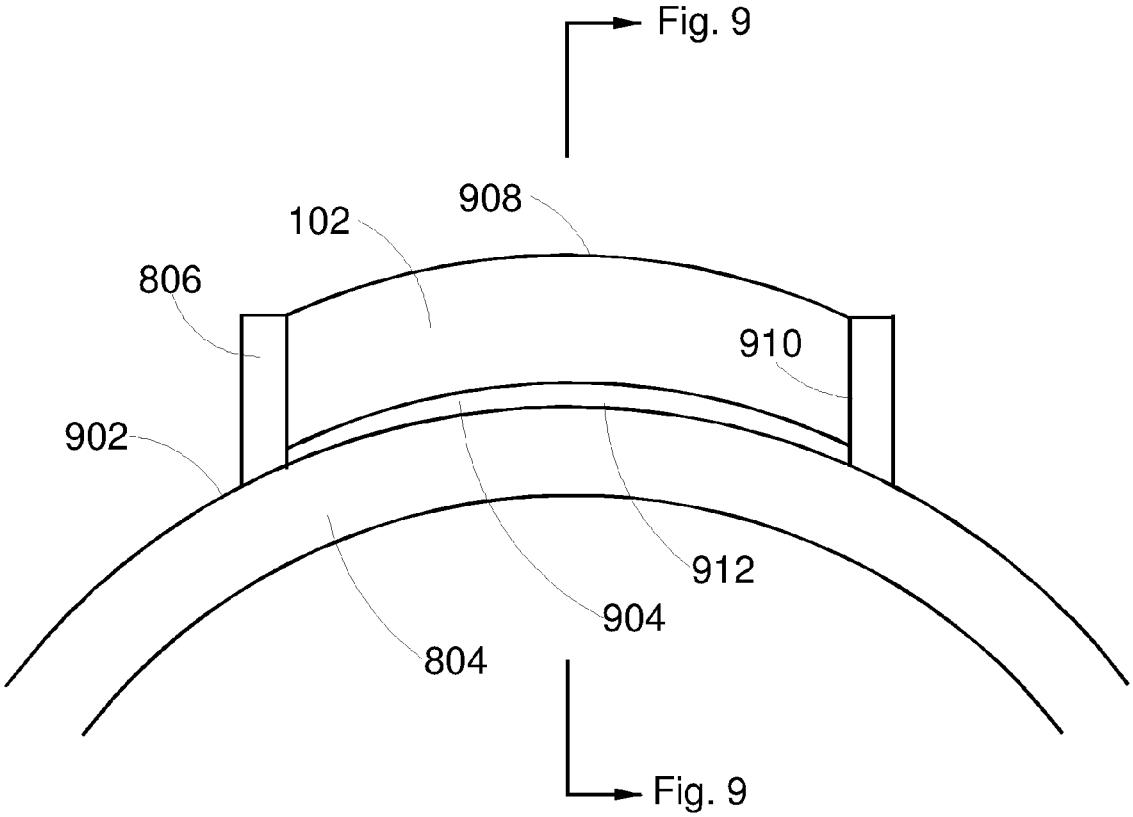
FIG. 10 illustrates a cross sectional view of the tonal material on a brass instrument according to one embodiment of the present invention.
Figure 11:
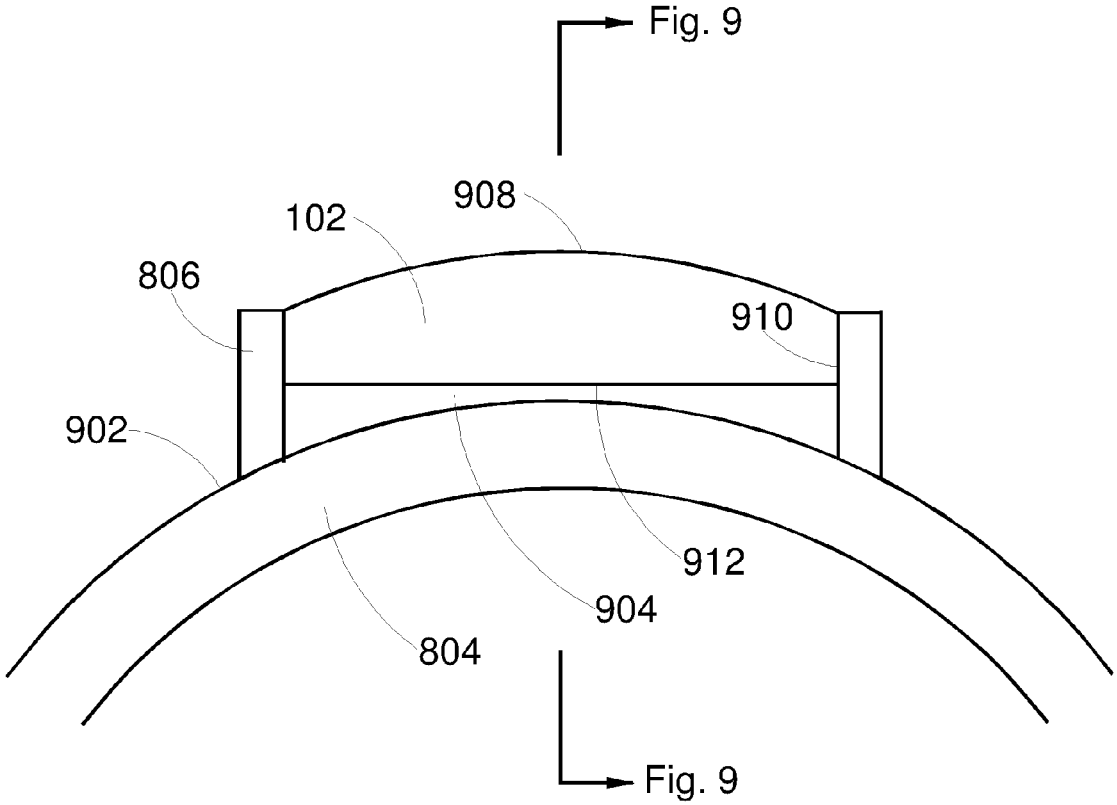
FIG. 11 illustrates a cross sectional view of the tonal material on a brass instrument according to one embodiment of the present invention.

FIGS. 10 and 11 also illustrate cross section views of the tonal material 102 placed on a brass instrument. FIG. 10 illustrates a concave curved bottom surface 912 of the tonal material 102. FIG. 11 illustrates that the bottom surface 912 of the tonal material 102 may be substantially straight. It is envisioned that this bottom surface 912 may also be convexly curved. In a further embodiment, this bottom surface 912 may contact the surface of the instrument 902 at only one point, or more than one point. In one particular embodiment, there is no side wall 608.

The tonal material may be any material that alters any of the tonal characteristics. Typically used on keys of brass instruments such as trumpets is mother of pearl. Mother of pearl, also known as nacre or sadaf, is calcium carbonate platelets with elastic biopolymers (such as chitin, lustrin, or the like). Mother of pearl has a Mohs hardness of from about 2.5 to about 4.5. The present invention envisions placing a tonal material on the body of the instrument. In one example, mother of pearl may be placed on the body of the instrument. The tonal materials in another embodiment of the present invention, typically have a Mohs hardness of greater than that of mother of pearl. The tonal materials of the present invention may also be more dense than mother of pearl. Some examples of tonal materials, (and the mohs hardness of some of them) that may be used include semi-precious stones such as garnet (6-7), jasper (6.5-7.5), agate (6.5-7), aventurine (6.5), carnelian (6.5-7), citrine (7), fluorite (4), hematite (5), malachite (3.5-4), obsidian (5-7), onyx (7), tiger's eye (7), turquoise (5-6), unakite (6-7), moonstone (6-6.5), peridot (6.5), jade (6.5-7), alexandrite (7-7.5), amethyst (7), chalcedony (7), quartz (7), aquamarine (7.5-8), lolite (7-7.5), rhodolite (7-7.5), opal (5-6), topaz (8), tourmaline (7-7.5), tanzanite (6.5); and precious stones such as diamond (10), emerald (8), sapphire (9), Ceylon sapphire (9), ruby (9), and the like; and other materials such as pumice (6), tungsten carbide (9), steel (6.5), silicon carbide (9), boron carbide (9), strontium titanate (6), emery (7-9), crystolon (9), corundum (9), and the like. In one embodiment, the tonal material is one with a Mohs hardness of at least 6.

EXAMPLES

In order to demonstrate the practice of the present invention, the following examples have been prepared. The examples should not, however, be viewed as limiting the scope of the invention. The claims will serve to define the invention.

The addition of stones to the trumpet has a dramatic improvement in the various tonal characteristics of the trumpet. In order to demonstrate the improvements in the sound emanating from a trumpet according to the present invention, several tests were performed. The tests results are summarized in Tables I and II. The testing involved using a 35670A Hewlett Packard Spectrum Analyzer with sound being recorded through calibrated condenser microphones made by ACO, ¼ inch model 7012 and ½ inch model 7017. The frequency range of the Spectrum Analyzer was set at 200 Hz to 6.6 kHz to an octave above that—concert B flat (472 Hz), and then the frequency range was changed from 200 Hz to 13 kHz for concert C (520 Hz). At these frequency ranges, the Spectrum Analyzer could measure and record the fundamental tone and the next 9 overtones or harmonics. Sound was measured in Hz or cycles per second of each fundamental tone and overtones as well as the volume amplitude of each fundamental tones and overtones.

The tests were conducted with the results recorded while playing an ascending scale starting at concert B flat (232 Hz and ending at concert C (520 Hz).

In order to control deviation between tests, each test was conducted using one trumpet by one professional trumpet player and using the same mouthpiece and playing position. Each note was played with a stone (as the tonal material) attached to the trumpet to the return side near the third valve, as illustrated in FIG. 2. Each note was played again with the stone removed As is shown in Table I, the frequency of each overtone, $1^{st}$ through $9^{th}$, is recorded for each of the two trumpet configurations (W meaning with stone, W/O meaning without stone), as well as the difference between the frequency with the stone and the frequency without the stone. At the bottom of Table I, the average difference of the frequencies played for each overtone is provided. All frequencies are in Hz. While the first overtone had virtually no measurable difference, each of the subsequent overtones showed a significant drop in frequency between the trumpet with stone and without, from 4 Hz at the third overtone to 64 Hz at the ninth.

It was further found that the second through sixth overtones actually have a greater amplitude than the fundamental frequency. As such, a change in frequency of one of the first through sixth overtones will have a dramatic affect on the sound of the trumpet. Also, even though the seventh, eighth and ninth overtones have an amplitude that is lower than the fundamental frequency, the measurable shift in frequency (64 Hz for both the eight and ninth overtones) is clearly audible.

As previously discussed, the human ear can detect frequency deviations as little as 2 Hz. As such, the trumpet with even a single stone exhibits a dramatic improvement in sound as each of the second through ninth overtone frequencies are diminished. The result is that the trumpet overtones become less sharp thus dramatically improving the player's ability to slot the desired pitch. It should also be noted, that the higher the overtones, the less effect they may have on the perception of the tonal characteristics. That is, if the $19^{th}$ overtone deviates by 2 Hz from standard, the tonal characteristics will not be as negatively affected as if the first or second overtones deviate by 2 Hz from standard. Another aspect that affects the tonal characteristics is the relative volume of the overtones. Overtones that are at least as loud as the fundamental note played have more of an effect on tonal characteristics than do overtones that are not as loud as the fundamental note played.

As further illustrated in Table II, the amplitude in dB of each overtone, first through fifth, was recorded. In Table II is recorded the percent difference between the respective overtone and the note played with and without the stone. Further recorded is the difference the results recorded with the stone and those recorded without the stone. For example, when the C was played, the second overtone with the stone recorded a decibel level 111.15% of the note played with a stone. The second overtone decibel level without the stone was 123.76% of the note played. The difference between the two is −12.61%, meaning that the overtone of the note played with the stone exhibited a less substantial increase in decibel level than the overtone of the note played without the stone. In each such overtone, the amplitude of the overtones was decreased when a single stone was used by an average of approximately 4 to 5 percent. Because the actual amplitude of sound of each of these overtones was reduced, the sound of the fundamental note becomes more pronounced. That is, using a stone on the side of the trumpet changes the timbre of the trumpet by lowering the intensity of the overtones causing the fundamental tone to be more present. Listeners stated that this improved the tone and created a more focused and centered sound. From a players perspective, the trumpet becomes easier to slot to the desired pitch. The test data shows that the sound of the trumpet of the present invention has improved tone quality, focus, clarity, character, warmth, centering of sound and depth. Each of these improvements in the tonal characteristics of the trumpet are a result of the overtones being diminished in both frequency and amplitude to cause the trumpet to become more "true" to the note being played making it easier to play and significantly better sounding.

TABLE I

| | 1st Overtone | | | 2nd Overtone | | | 3rd Overtone | | | 4th Overtone | | |
|---|---|---|---|---|---|---|---|---|---|---|---|---|
| | W | W/O | Difference | W | W/O | Difference | W | W/O | Difference | W | W/O | Difference |
| B♭ | 472 | 472 | 0 | 696 | 712 | −16 | 936 | 936 | 0 | 1176 | 1176 | 0 |
| C | 536 | 536 | 0 | 792 | 792 | 0 | 1064 | 1064 | 0 | 1336 | 1336 | 0 |
| D | 584 | 584 | 0 | 888 | 888 | 0 | 1176 | 1176 | 0 | 1480 | 1480 | 0 |
| E♭ | 632 | 632 | 0 | 936 | 952 | −16 | 1256 | 1256 | 0 | 1560 | 1576 | −16 |
| F | 696 | 696 | 0 | 1048 | 1064 | −16 | 1384 | 1416 | −32 | 1736 | 1768 | −32 |
| G | 792 | 792 | 0 | 1176 | 1192 | −16 | 1576 | 1576 | 0 | 1976 | 1976 | 0 |
| A | 872 | 872 | 0 | 1320 | 1320 | 0 | 1752 | 1752 | 0 | 2200 | 2200 | 0 |
| B♭ | 936 | 936 | 0 | 1400 | 1400 | 0 | 1880 | 1880 | 0 | 2344 | 2344 | 0 |
| C | 1032 | 1032 | 0 | 1575 | 1576 | −1 | 2088 | 2088 | 0 | 2600 | 2600 | 0 |
| Average Difference | | | 0 | | | −7 | | | −4 | | | −5 |

| | 5th Overtone | | | 6th Overtone | | | 7th Overtone | | | 8th Overtone | | |
|---|---|---|---|---|---|---|---|---|---|---|---|---|
| | W | W/O | Difference | W | W/O | Difference | W | W/O | Difference | W | W/O | Difference |
| B♭ | 1400 | 1416 | −16 | 1640 | 1640 | 0 | 1864 | 1880 | −16 | 2104 | 2120 | −16 |
| C | 1592 | 1592 | 0 | 1864 | 1864 | 0 | 2136 | 2136 | 0 | 2392 | 2408 | −16 |
| D | 1768 | 1768 | 0 | 2072 | 2072 | 0 | 2360 | 2360 | 0 | 2648 | 2664 | −16 |
| E♭ | 1880 | 1896 | −16 | 2200 | 2216 | −16 | 2504 | 2520 | −16 | 2824 | 2840 | −16 |
| F | 2088 | 2104 | −16 | 2424 | 2456 | −32 | 2776 | 2808 | −32 | 3128 | 3176 | −48 |
| G | 2360 | 2376 | −16 | 2760 | 2760 | 0 | 3144 | 3160 | −16 | 3544 | 3560 | −16 |

TABLE I-continued

| | | | | | | | | | | | | |
|---|---|---|---|---|---|---|---|---|---|---|---|---|
| A | 2632 | 2632 | 0 | 3064 | 3080 | −16 | 3512 | 3512 | 0 | 3960 | 4408 | −448 |
| B♭ | 2808 | 2808 | 0 | 3272 | 3272 | 0 | 3752 | 3752 | 0 | 4216 | 4216 | 0 |
| C | 3140 | 3144 | −4 | 3656 | 3656 | 0 | 4168 | 4168 | 0 | 4712 | 4712 | 0 |
| Average Difference | | | −8 | | | −7 | | | −9 | | | −64 |

| | 9th Overtone | | |
|---|---|---|---|
| | W | W/O | Difference |
| B♭ | 2328 | 2360 | −32 |
| C | 2664 | 2664 | 0 |
| D | 2952 | 2952 | 0 |
| E♭ | 3128 | 3144 | −16 |
| F | 3480 | 3528 | −48 |
| G | 3944 | 3944 | 0 |
| A | 4392 | 4840 | −448 |
| B♭ | 4680 | 4680 | 0 |
| C | 5192 | 5224 | −32 |
| Average Difference | | −64 | |

TABLE II

| | 1st Overtone | | | 2nd Overtone | | | 3rd Overtone | | |
|---|---|---|---|---|---|---|---|---|---|
| Note | W | W/O | Difference | W | W/O | Difference | W | W/O | Difference |
| B♭ | 118.55% | 118.13% | 0.42% | 126.75% | 118.34% | 8.41% | 122.99% | 116.73% | 6.26% |
| C | 108.82% | 127.56% | −18.74% | 111.15% | 123.76% | −12.61% | 124.00% | 125.51% | −1.51% |
| D | 113.04% | 118.95% | −5.91% | 113.29% | 117.20% | −3.91% | 102.58% | 108.37% | −5.79% |
| E♭ | 108.98% | 112.98% | −4.00% | 105.31% | 108.58% | −3.27% | 104.94% | 99.37% | 5.57% |
| F | 107.16% | 106.13% | 1.03% | 116.10% | 103.53% | 12.57% | 109.06% | 103.16% | 5.90% |
| G | 104.55% | 108.15% | −3.60% | 117.88% | 112.51% | 5.37% | 93.00% | 95.26% | −2.26% |
| A | 109.61% | 115.16% | −5.55% | 113.68% | 121.58% | −7.90% | 90.54% | 98.28% | −7.74% |
| B♭ | 110.76% | 112.47% | −1.71% | 109.84% | 112.10% | −2.26% | 83.91% | 85.87% | −1.96% |
| C | 121.96% | 125.85% | −3.89% | 98.02% | 108.67% | −10.65% | 73.11% | 90.12% | −17.01% |
| D | 112.36% | 111.90% | 0.46% | 82.76% | 90.30% | −7.54% | 59.63% | 69.82% | −10.19% |
| E♭ | 100.59% | 104.35% | −3.76% | 63.58% | 79.23% | −15.65% | 47.22% | 65.51% | −18.29% |
| F | 100.39% | 104.40% | −4.01% | 56.48% | 73.80% | −17.32% | 39.85% | 53.38% | −13.53% |
| Average Difference | | −4.11% | | | −4.56% | | | −5.05% | |

| | 4th Overtone | | | 5th Overtone | | |
|---|---|---|---|---|---|---|
| Note | W | W/O | Difference | W | W/O | Difference |
| B♭ | 140.87% | 117.94% | 22.93% | 123.01% | 104.99% | 18.02% |
| C | 105.70% | 122.71% | −17.01% | 93.98% | 109.80% | −15.82% |
| D | 94.39% | 95.94% | −1.55% | 91.36% | 89.06% | 2.30% |
| E♭ | 86.06% | 88.68% | −2.62% | 74.35% | 77.39% | −3.04% |
| F | 93.50% | 86.87% | 6.63% | 76.87% | 69.26% | 7.61% |
| G | 76.79% | 83.24% | −6.45% | 63.75% | 71.17% | −7.42% |
| A | 69.86% | 77.13% | −7.27% | 54.94% | 61.59% | −6.65% |
| B♭ | 64.81% | 67.30% | −2.49% | 51.75% | 56.19% | −4.44% |
| C | 56.49% | 71.15% | −14.66% | 41.63% | 57.01% | −15.38% |
| D | 40.32% | 51.12% | −10.80% | 35.44% | 43.86% | −8.42% |
| E♭ | 33.53% | 48.27% | −14.74% | 27.66% | 42.39% | −14.73% |
| F | 29.53% | 39.54% | −10.01% | 25.94% | 37.76% | −11.82% |
| Average Difference | | −4.84% | | | −4.98% | |

The stone used in the above examples had a Mohs hardness of greater than about 6. It is believed, but not meant to be limiting, that the density of the material over mother of pearl may also have an effect on the resonant properties of the trumpet that produce the results discussed above.

In summary, this application discloses in the present invention a method and design allowing for altering of the tonal characteristics of a brass instrument by attaching a tonal material on the brass instrument. The brass instrument may be any as described above. The location of attachment may be any as described above. The tonal material may be any as described above. The attachment may or may not include a housing and/or an adhesive, as described above.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claim rather than by the foregoing description. All changes which come within the meaning and range of equivalency of the claims are to be embraced within their scope.

For example, although the figures illustrate that the brass instrument is a trumpet or the like, it is envisioned that any brass instrument is within the bounds of this invention. Some examples of brass instruments upon which this invention may be applied include trumpets, bass trumpets, flumpets, French horns, tubas, Wagner tubas, trombones, superbones, bugles, sousaphones, mellophones, euphoniums, flugelhorns, saxhorns, cornets, cornettos, serpents, sackbuts, bazookas, horns, ophicleides, didgeridoos, shofars, conches, alphorns, cimbassos, and keyed trumpets.

Additionally, although the figures illustrate an oval-shaped tonal material, it is envisioned that any shape of tonal material that may alter any of the tonal characteristics may be used in the present invention. Some examples of shapes that may be used include oval, circular, triangular, rectangular, square, polygonal, egg-shaped, pyramidal, cubic, toroidal, and so forth.

It is also envisioned that the tonal material may be placed anywhere on the brass instrument. The tonal material may be placed where it may affect the tonal characteristics. For example, the tonal material may substantially or completely encircle a tubular member of the brass instrument. Further, the tonal material may replace a portion of the brass instrument. For example, a portion of the return side of a trumpet may be replaced by a tubular portion of tonal material such as semi-precious stone.

It should be noted that in one particular embodiment, the tonal material are naturally-occurring stones, materials and the like. In yet another particular embodiment, the hardness of the naturally occurring tonal materials is greater than that of mother-of-pearl.

Finally, it is envisioned that the components of the brass instrument may be constructed of a variety of materials. It is not necessary that the brass instrument be constructed of brass, as brass identifies a class of instrument, not the material from which it is constructed. Brass instruments may be constructed of a variety of materials, such as plastics, composites, wood, metals, alloys, crystalline structures, stone, fiber, glass, and so forth.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

EXAMPLES

In order to demonstrate the practice of the present invention, the following examples have been prepared. The examples should not, however, be viewed as limiting the scope of the invention. The claims will serve to define the invention.

The addition of stones to the trumpet has a dramatic improvement in the various tonal characteristics of the trumpet. In order to demonstrate the improvements in the sound emanating from a trumpet according to the present invention, several tests were performed. The tests results are summarized in Tables I and II. The testing involved using a 35670A Hewlett Packard Spectrum Analyzer with sound being recorded through calibrated condenser microphones made by ACO, ¼ inch model 7012 and ½ inch model 7017. The frequency range of the Spectrum Analyzer was set at 200 Hz to 6.6 kHz to an octave above that—concert B flat (472 Hz), and then the frequency range was changed from 200 Hz to 13 kHz for concert C (520 Hz). At these frequency ranges, the Spectrum Analyzer could measure and record the fundamental tone and the next 9 overtones or harmonics. Sound was measured in Hz or cycles per second of each fundamental tone and overtones as well as the volume amplitude of each fundamental tones and overtones.

The tests were conducted with the results recorded while playing an ascending scale starting at concert B flat (232 Hz and ending at concert C (520 Hz).

In order to control deviation between tests, each test was conducted using one trumpet by one professional trumpet player and using the same mouthpiece and playing position. Each note was played with a stone (as the tonal material) attached to the trumpet to the return side near the third valve, as illustrated in FIG. 2. Each note was played again with the stone removed As is shown in Table I, the frequency of each overtone, $1^{st}$ through $9^{th}$, is recorded for each of the two trumpet configurations (W meaning with stone, W/O meaning without stone), as well as the difference between the frequency with the stone and the frequency without the stone. At the bottom of Table I, the average difference of the frequencies played for each overtone is provided. All frequencies are in Hz. While the first overtone had virtually no measurable difference, each of the subsequent overtones showed a significant drop in frequency between the trumpet with stone and without, from 4 Hz at the third overtone to 64 Hz at the ninth.

It was further found that the second through sixth overtones actually have a greater amplitude than the fundamental frequency. As such, a change in frequency of one of the first through sixth overtones will have a dramatic affect on the sound of the trumpet. Also, even though the seventh, eighth and ninth overtones have an amplitude that is lower than the fundamental frequency, the measurable shift in frequency (64 Hz for both the eight and ninth overtones) is clearly audible.

As previously discussed, the human ear can detect frequency deviations as little as 2 Hz. As such, the trumpet with even a single stone exhibits a dramatic improvement in sound as each of the second through ninth overtone frequencies are diminished. The result is that the trumpet overtones become less sharp thus dramatically improving the player's ability to slot the desired pitch. It should also be noted, that the higher the overtones, the less effect they may have on the perception of the tonal characteristics. That is, if the $19^{th}$ overtone deviates by 2 Hz from standard, the tonal characteristics will not be as negatively affected as if the first or second overtones deviate by 2 Hz from standard. Another aspect that affects the tonal characteristics is the relative volume of the overtones. Overtones that are at least as loud as the fundamental note played have more of an effect on tonal characteristics than do overtones that are not as loud as the fundamental note played.

As further illustrated in Table II, the amplitude in dB of each overtone, first through fifth, was recorded. In Table II is recorded the percent difference between the respective overtone and the note played with and without the stone. Further recorded is the difference the results recorded with the stone and those recorded without the stone. For example, when the C was played, the second overtone with the stone recorded a decibel level 111.15% of the note played with a stone. The second overtone decibel level without the stone was 123.76% of the note played. The difference between the two is −12.61%, meaning that the overtone of the note played with the stone exhibited a less substantial increase in decibel level than the overtone of the note played without the stone. In each such overtone, the amplitude of the overtones was decreased when a single stone was used by an average of approximately 4 to 5 percent. Because the actual amplitude of sound of each of these overtones was reduced, the sound of the fundamental note becomes more pronounced. That is, using a stone on the side of the trumpet changes the timbre of the trumpet by lowering the intensity of the overtones causing the fundamental tone to be more present. Listeners stated that this improved the tone and created a more focused and centered sound. From a players perspective, the trumpet becomes easier to slot to the desired pitch. The test data shows that the sound of the trumpet of the present invention has improved tone quality, focus, clarity, character, warmth, centering of sound and depth. Each of these improvements in the tonal characteristics of the trumpet are a result of the overtones being diminished in both frequency and amplitude to cause the trumpet to become more "true" to the note being played making it easier to play and significantly better sounding.

TABLE I

| | 1st Overtone | | | 2nd Overtone | | | 3rd Overtone | | | 4th Overtone | | |
|---|---|---|---|---|---|---|---|---|---|---|---|---|
| | W | W/O | Difference | W | W/O | Difference | W | W/O | Difference | W | W/O | Difference |
| B♭ | 472 | 472 | 0 | 696 | 712 | −16 | 936 | 936 | 0 | 1176 | 1176 | 0 |
| C | 536 | 536 | 0 | 792 | 792 | 0 | 1064 | 1064 | 0 | 1336 | 1336 | 0 |
| D | 584 | 584 | 0 | 888 | 888 | 0 | 1176 | 1176 | 0 | 1480 | 1480 | 0 |
| E♭ | 632 | 632 | 0 | 936 | 952 | −16 | 1256 | 1256 | 0 | 1560 | 1576 | −16 |
| F | 696 | 696 | 0 | 1048 | 1064 | −16 | 1384 | 1416 | −32 | 1736 | 1768 | −32 |
| G | 792 | 792 | 0 | 1176 | 1192 | −16 | 1576 | 1576 | 0 | 1976 | 1976 | 0 |
| A | 872 | 872 | 0 | 1320 | 1320 | 0 | 1752 | 1752 | 0 | 2200 | 2200 | 0 |
| B♭ | 936 | 936 | 0 | 1400 | 1400 | 0 | 1880 | 1880 | 0 | 2344 | 2344 | 0 |
| C | 1032 | 1032 | 0 | 1575 | 1576 | −1 | 2088 | 2088 | 0 | 2600 | 2600 | 0 |
| Average Difference | | 0 | | | −7 | | | −4 | | | −5 | |

| | 5th Overtone | | | 6th Overtone | | | 7th Overtone | | | 8th Overtone | | |
|---|---|---|---|---|---|---|---|---|---|---|---|---|
| | W | W/O | Difference | W | W/O | Difference | W | W/O | Difference | W | W/O | Difference |
| B♭ | 1400 | 1416 | −16 | 1640 | 1640 | 0 | 1864 | 1880 | −16 | 2104 | 2120 | −16 |
| C | 1592 | 1592 | 0 | 1864 | 1864 | 0 | 2136 | 2136 | 0 | 2392 | 2408 | −16 |
| D | 1768 | 1768 | 0 | 2072 | 2072 | 0 | 2360 | 2360 | 0 | 2648 | 2664 | −16 |
| E♭ | 1880 | 1896 | −16 | 2200 | 2216 | −16 | 2504 | 2520 | −16 | 2824 | 2840 | −16 |
| F | 2088 | 2104 | −16 | 2424 | 2456 | −32 | 2776 | 2808 | −32 | 3128 | 3176 | −48 |
| G | 2360 | 2376 | −16 | 2760 | 2760 | 0 | 3144 | 3160 | −16 | 3544 | 3560 | −16 |
| A | 2632 | 2632 | 0 | 3064 | 3080 | −16 | 3512 | 3512 | 0 | 3960 | 4408 | −448 |
| B♭ | 2808 | 2808 | 0 | 3272 | 3272 | 0 | 3752 | 3752 | 0 | 4216 | 4216 | 0 |
| C | 3140 | 3144 | −4 | 3656 | 3656 | 0 | 4168 | 4168 | 0 | 4712 | 4712 | 0 |
| Average Difference | | −8 | | | −7 | | | −9 | | | −64 | |

| | 9th Overtone | | |
|---|---|---|---|
| | W | W/O | Difference |
| B♭ | 2328 | 2360 | −32 |
| C | 2664 | 2664 | 0 |
| D | 2952 | 2952 | 0 |
| E♭ | 3128 | 3144 | −16 |
| F | 3480 | 3528 | −48 |
| G | 3944 | 3944 | 0 |
| A | 4392 | 4840 | −448 |
| B♭ | 4680 | 4680 | 0 |
| C | 5192 | 5224 | −32 |
| Average Difference | | −64 | |

TABLE II

| | 1st Overtone | | | 2nd Overtone | | | 3rd Overtone | | |
|---|---|---|---|---|---|---|---|---|---|
| Note | W | W/O | Difference | W | W/O | Difference | W | W/O | Difference |
| B♭ | 118.55% | 118.13% | 0.42% | 126.75% | 118.34% | 8.41% | 122.99% | 116.73% | 6.26% |
| C | 108.82% | 127.56% | −18.74% | 111.15% | 123.76% | −12.61% | 124.00% | 125.51% | −1.51% |
| D | 113.04% | 118.95% | −5.91% | 113.29% | 117.20% | −3.91% | 102.58% | 108.37% | −5.79% |
| E♭ | 108.98% | 112.98% | −4.00% | 105.31% | 108.58% | −3.27% | 104.94% | 99.37% | 5.57% |
| F | 107.16% | 106.13% | 1.03% | 116.10% | 103.53% | 12.57% | 109.06% | 103.16% | 5.90% |

TABLE II-continued

| | | | | | | | | | |
|---|---|---|---|---|---|---|---|---|---|
| G | 104.55% | 108.15% | −3.60% | 117.88% | 112.51% | 5.37% | 93.00% | 95.26% | −2.26% |
| A | 109.61% | 115.16% | −5.55% | 113.68% | 121.58% | −7.90% | 90.54% | 98.28% | −7.74% |
| B♭ | 110.76% | 112.47% | −1.71% | 109.84% | 112.10% | −2.26% | 83.91% | 85.87% | −1.96% |
| C | 121.96% | 125.85% | −3.89% | 98.02% | 108.67% | −10.65% | 73.11% | 90.12% | −17.01% |
| D | 112.36% | 111.90% | 0.46% | 82.76% | 90.30% | −7.54% | 59.63% | 69.82% | −10.19% |
| E♭ | 100.59% | 104.35% | −3.76% | 63.58% | 79.23% | −15.65% | 47.22% | 65.51% | −18.29% |
| F | 100.39% | 104.40% | −4.01% | 56.48% | 73.80% | −17.32% | 39.85% | 53.38% | −13.53% |
| Average Difference | | −4.11% | | | −4.56% | | | −5.05% | |

| | 4th Overtone | | | 5th Overtone | | |
|---|---|---|---|---|---|---|
| Note | W | W/O | Difference | W | W/O | Difference |
| B♭ | 140.87% | 117.94% | 22.93% | 123.01% | 104.99% | 18.02% |
| C | 105.70% | 122.71% | −17.01% | 93.98% | 109.80% | −15.82% |
| D | 94.39% | 95.94% | −1.55% | 91.36% | 89.06% | 2.30% |
| E♭ | 86.06% | 88.68% | −2.62% | 74.35% | 77.39% | −3.04% |
| F | 93.50% | 86.87% | 6.63% | 76.87% | 69.26% | 7.61% |
| G | 76.79% | 83.24% | −6.45% | 63.75% | 71.17% | −7.42% |
| A | 69.86% | 77.13% | −7.27% | 54.94% | 61.59% | −6.65% |
| B♭ | 64.81% | 67.30% | −2.49% | 51.75% | 56.19% | −4.44% |
| C | 56.49% | 71.15% | −14.66% | 41.63% | 57.01% | −15.38% |
| D | 40.32% | 51.12% | −10.80% | 35.44% | 43.86% | −8.42% |
| E♭ | 33.53% | 48.27% | −14.74% | 27.66% | 42.39% | −14.73% |
| F | 29.53% | 39.54% | −10.01% | 25.94% | 37.76% | −11.82% |
| Average Difference | | −4.84% | | | −4.98% | |

The stone used in the above examples had a Mohs hardness of greater than about 6. It is believed, but not meant to be limiting, that the density of the material over mother of pearl may also have an effect on the resonant properties of the trumpet that produce the results discussed above.

What is claimed is:

1. A method of improving the tonal characteristics of a brass instrument, comprising the steps of:

identifying a position on the brass instrument, wherein placement of a tonal material thereto causes a lowering of overtone amplitude during play, by observing overtone characteristics during play; and attaching the tonal material to the brass instrument, at the position.

2. The method of claim 1, wherein the tonal material comprises one of the group consisting of: garnet, jasper, agate, aventurine, carnelian, citrine, fluorite, hematite, malachite, obsidian, onyx, tiger's eye, turquoise, unakite, moonstone, peridot, jade, alexandrite, amethyst, chalcedony, quartz, aquamarine, lolite, rhodolite, opal, topaz, tourmaline, tauzanite, diamond, emerald, sapphire, ceylon sapphire, ruby, brass, other metals, and combinations thereof.

3. The method of claim 1, wherein the tonal material is not mother-of-pearl.

4. The method of claim 1, further comprising the step of attaching a housing to the brass instrument.

5. The method of claim 4, further comprising inserting the tonal material into the housing.

6. The method of claim 1, wherein the brass instrument comprises one of the group consisting of: trumpet, bass trumpet, flumpet, French horn, tuba, Wagner tuba, trombone, superbone, bugle, sousaphone, mellophone, euphonium, flugelhorn, saxhorn, cornetto, serpent, sackbut, bazooka, horn, ophicleide, didgeridoo, shofar, conch, alphorn, cornet, cimbasso, and keyed trumpet.

7. The method of claim 1, further comprising playing a brass instrument.

8. A method of improving the tonal characteristics of a brass instrument, comprising the steps of:

identifying a position on the brass instrument, wherein placement of a tonal material thereto causes a lowering of overtone amplitude during play, by observing overtone characteristics during play;

attaching the tonal material to he brass instrument, at the position; and further comprising the step of attaching a housing to the brass instrument.

9. The method of claim 8, wherein the tonal material comprises one of the group consisting of: garnet, jasper, agate, aventurine, carnelian, citrine, fluorite, hematite, malachite, obsidian, onyx, tiger's eye, turquoise, unakite, moonstone, peridot, jade, alexandrite, amethyst, chalcedony, quartz, aquamarine, lolite, rhodolite, opal, topaz, tourmaline, tanzanite, diamond, emerald, sapphire, ceylon sapphire, ruby, brass, other metals, and combinations thereof.

10. The method of claim 8, wherein the tonal material is not mother-of-pearl.

11. The method of claim 8, further comprising the step of inserting the tonal material into the housing.

12. The method of claim 8, wherein the brass instrument comprises one of the group consisting of: trumpet, bass trumpet, flumpet, French horn, tuba, Wagner tuba, trombone, superbone, bugle, sousaphone, mellophone, euphonium, flugelhorn, saxhorn, cornetto, serpent, sackbut, bazooka, horn, ophicleide, didgeridoo, shofar, conch, alphorn, cornet, cimbasso, and keyed trumpet.

13. The method of claim 8, further comprising playing a brass instrument.

14. A method of improving the tonal characteristics of a brass instrument, comprising the steps of:

identifying a position on the brass instrument, wherein placement of a tonal material thereto causes a lowering of overtone amplitude during play, by observing overtone characteristics during play;

positioning the tonal material to the brass instrument;

measuring the overtone amplitude;

playing the brass instrument; and repositioning the tonal material to optimal overtone amplitude position; and attaching the tonal material to the brass instrument, at the optimal overtone amplitude position.

15. The method of claim 13, wherein the tonal material comprises one or more of the group consisting of: garnet, jasper, agate, aventurine, carnelian, citrine, fluorite, hematite, malachite, obsidian, onyx, tiger's eye, turquoise, unakite, moonstone, peridot, jade, alexandrite, amethyst, chalcedony, quartz, aquamarine, lolite, rhodolite, opal, topaz, tourmaline, tanzanite, diamond, emerald, sapphire, ceylon sapphire, ruby, brass, other metals, and combinations thereof.

16. The method of claim 13, further comprising the step of attaching a housing to the brass instrument.

17. The method of claim 13, further comprising the step of inserting the tonal material into the housing.

18. The method of claim 13, wherein the brass instrument comprises one of the group consisting of: trumpet, bass trumpet, flumpet, French horn, tuba, Wagner tuba, trombone, superbone, bugle, sousaphone, mellophone, euphonium, flugelhorn, saxhorn, cornetto, serpent, sackbut, bazooka, horn, ophicleide, didgeridoo, shofar, conch, alphorn, cornet, cimbasso, and keyed trumpet.

* * * * *